US010260738B2

(12) United States Patent
Larouche et al.

(10) Patent No.: US 10,260,738 B2
(45) Date of Patent: Apr. 16, 2019

(54) STEAM GENERATOR USING A PLASMA ARC

(71) Applicant: ENTREPRISE ÉLECTRIQUE M.J.L. INC., Ste-marie Madeleine (CA)

(72) Inventors: Maxime Larouche, Ste-marie Madeleine (CA); Jean-Louis Larouche, Ste-marie Madeleine (CA)

(73) Assignee: Entreprise Electrique M.J.L. Inc., Ste-Marie Madeleine, QC (CA)

( * ) Notice: Subject to any disclaimer, the term of this patent is extended or adjusted under 35 U.S.C. 154(b) by 675 days.

(21) Appl. No.: 14/799,209

(22) Filed: Jul. 14, 2015

(65) Prior Publication Data

US 2017/0016614 A1 Jan. 19, 2017

(51) Int. Cl.
*B23K 10/00* (2006.01)
*F22B 1/30* (2006.01)

(52) U.S. Cl.
CPC ..... *F22B 1/30* (2013.01)

(58) Field of Classification Search
CPC ... F22B 1/30; H05H 1/34; H05H 1/26; H05H 1/36
USPC ..... 219/121.52, 121.48, 121.36
See application file for complete search history.

(56) References Cited

U.S. PATENT DOCUMENTS 2,961,525 A * 11/1960 Riker ..... F22B 1/30 219/481
4,320,306 A * 3/1982 Kohga ..... H02P 9/14 307/20
5,523,550 A * 6/1996 Kimura ..... F24H 1/101 219/628
5,946,342 A * 8/1999 Koslow ..... H05B 3/60 373/109
2011/0024397 A1* 2/2011 Lin ..... H05H 1/3405 219/121.5
2017/0111985 A1* 4/2017 Foret ..... H05H 1/38
2017/0135191 A1* 5/2017 Foret ..... H05H 1/34

FOREIGN PATENT DOCUMENTS

WO WO 2010/041113 * 4/2010 ..... B01L 19/08

* cited by examiner

*Primary Examiner* — Mark Paschall
(74) *Attorney, Agent, or Firm* — BakerHostetler

(57) ABSTRACT

A steam generator using a plasma arc submerged in electrolyte including an electrode assembly for forming the plasma arc, an electrical power source to energize the electrode assembly and an electronic rectifier operatively connected between the power source and the terminal connections. The electronic rectifier comprises a controllable switch for rectifying an input voltage and a monitoring-controller connected to the controllable switch for controlling said controllable switch. The monitoring-controller engages the controllable switch upon sensing a substantially zero input voltage for initiating a gradual plasma arc, heating the electrolyte and generating steam therefrom.

23 Claims, 7 Drawing Sheets

STEAM GENERATOR USING A PLASMA ARC

FIELD OF THE INVENTION

The present invention relates to steam generators. More particularly, the present invention relates to a steam generator using a plasma arc submerged in electrolyte.

BACKGROUND OF THE INVENTION

Steam generators are commonly used in industrial and domestic settings. For example, in agriculture, steam can be used for soil sterilization while domestically, steam can be used for cleaning fabric and carpets.

Generating steam using heat exchangers is known in the field of heat transfer. Conventional systems are generally bulky and difficult to transport. They also have a slow reaction time due to the inertia of the heating process. Typically, a heating element is used to heat a liquid, such as water, to its boiling point.

A steam generator is a device that uses a heat source to boil water and convert it into its vapor form, referred to as steam. The heat may be derived from an electrical source or the combustion of fuel such as coal, natural gas, nuclear fission reactors, etc. To readily have access to steam, these types of steam generators usually require the heater to remain active and thus waste energy.

Therefore, there is a need for a steam generator to rapidly and efficiently generate steam when activated.

Hence, in light of the aforementioned, there is a need for an improved system which, by virtue of its design and components, would be able to overcome some of the above-discussed prior art concerns.

SUMMARY OF THE INVENTION

The object of the present invention is to provide a device which, by virtue of its design and components, satisfies some of the above-mentioned needs and is thus an improvement over other related steam generators known in the prior art.

In accordance with the present invention, the above mentioned object is achieved, as will be easily understood, by a steam generator such as the one briefly described herein and such as the one exemplified in the accompanying drawings.

According to a first aspect of the present invention, there is provided a steam generator using a plasma arc submerged in electrolyte. The steam generator comprises:

- a chamber having a vertical axis, said chamber includes an electrically non-conductive outer wall, a base surface and a top surface, said base surface and top surface are located at opposite ends of the chamber along the vertical axis, wherein the top surface includes at least one aperture for introducing the electrolyte and removing the steam;
- an electrode assembly comprising:
  - a first electrode having a longitudinally extending spiral shape along a longitudinal axis mounted inside the chamber; and
  - a second electrode having a flat spiral shape in a plane mounted inside the chamber relative to the first electrode for forming the plasma arc;
- an electrical power source to energize the electrode assembly with an input voltage;

- terminal connections operatively connecting the first electrode and the second electrode to the power source; and
- an electronic rectifier operatively connected between the power source and the terminal connections, comprising:
  - a controllable switch for rectifying the input voltage; and
  - a monitoring-controller connected to the controllable switch for controlling said controllable switch;
- wherein the monitoring-controller engages the controllable switch upon sensing a substantially zero input voltage for initiating a gradual plasma arc, heating the electrolyte and generating steam therefrom.

In some implementations, the base surface includes one aperture for introducing the electrolyte.

In some implementations, the chamber further comprises a deflector for urging the electrolyte towards the electrode assembly.

In some implementations, the deflector comprises an electrically non-conductive and heat resistant material.

In some implementations, the chamber is sized such that the electrolyte defines a first volume while the first electrode defines a second volume, such that a ratio of the first volume to the second volume inside the chamber is between 3 to 15.

In some implementations, the ratio of the first volume to the second volume is between 6 to 10.

In some implementations, the at least one aperture is closable.

In some implementations, the electrode assembly comprises a high emissivity material.

In some implementations, the first electrode is a cathode.

In some implementations, the first electrode has a length starting with a circular cross-section at the beginning of the length and ending with an oval cross-section at the end of the length.

In some implementations, the second electrode is an anode.

In some implementations, the longitudinal axis of the first electrode is substantially parallel to the vertical axis of the chamber.

In some implementations, the plane of the second electrode is substantially perpendicular to the longitudinal axis of the first electrode.

In some implementations, the first electrode is placed at a distance ranging between 10 mm to 150 mm from the second electrode.

In some implementations, the first electrode is placed at a distance ranging between 15.4 mm to 64.5 mm from the second electrode.

In some implementations, the input voltage of the electrical power source ranges between 200 V to 12 000 V AC.

In some implementations, the input voltage of the electrical power source ranges between 200 V to 600 V AC.

In some implementations, the terminal connections comprise an electrically conductive inner core and an electrically non-conductive outer jacket.

In some implementations, the inner core comprises copper.

In some implementations, the outer jacket comprises ceramic.

In some implementations, the electronic rectifier produces a rectified DC voltage.

In some implementations, the electronic rectifier comprises at least one current controlling device selected from a group consisting of thyristors, silicon-controlled rectifiers and insulated-gate bipolar transistors.

In some implementations, the electrolyte comprises water and sodium hydrogen carbonate.

According to a second aspect of the present invention, there is provided a method for producing a constant flow output of steam using multiple electrode assemblies in a steam generator, the method comprising:

(a) monitoring an input voltage, having alternating input waves, of an AC electrical power source;
(b) rectifying the input voltage into a rectified voltage;
(c) conducting the rectified voltage to a first electrode assembly when the input voltage is substantially zero and starting a positive half cycle input wave;
(d) ceasing the rectified voltage from the first electrode assembly after conducting the positive half cycle input wave;
(e) waiting for a negative half cycle input wave to pass through; and
(f) conducting the rectified voltage to a second electrode assembly when the input voltage is substantially zero and starting a subsequent positive half cycle input wave.

The objects, advantages and features of the present invention will become more apparent upon reading of the following non-restrictive description of preferred embodiments thereof, given for the purpose of exemplification only, with reference to the accompanying drawings.

DETAILED DESCRIPTION OF PREFERRED EMBODIMENTS OF THE INVENTION

Figure 1:
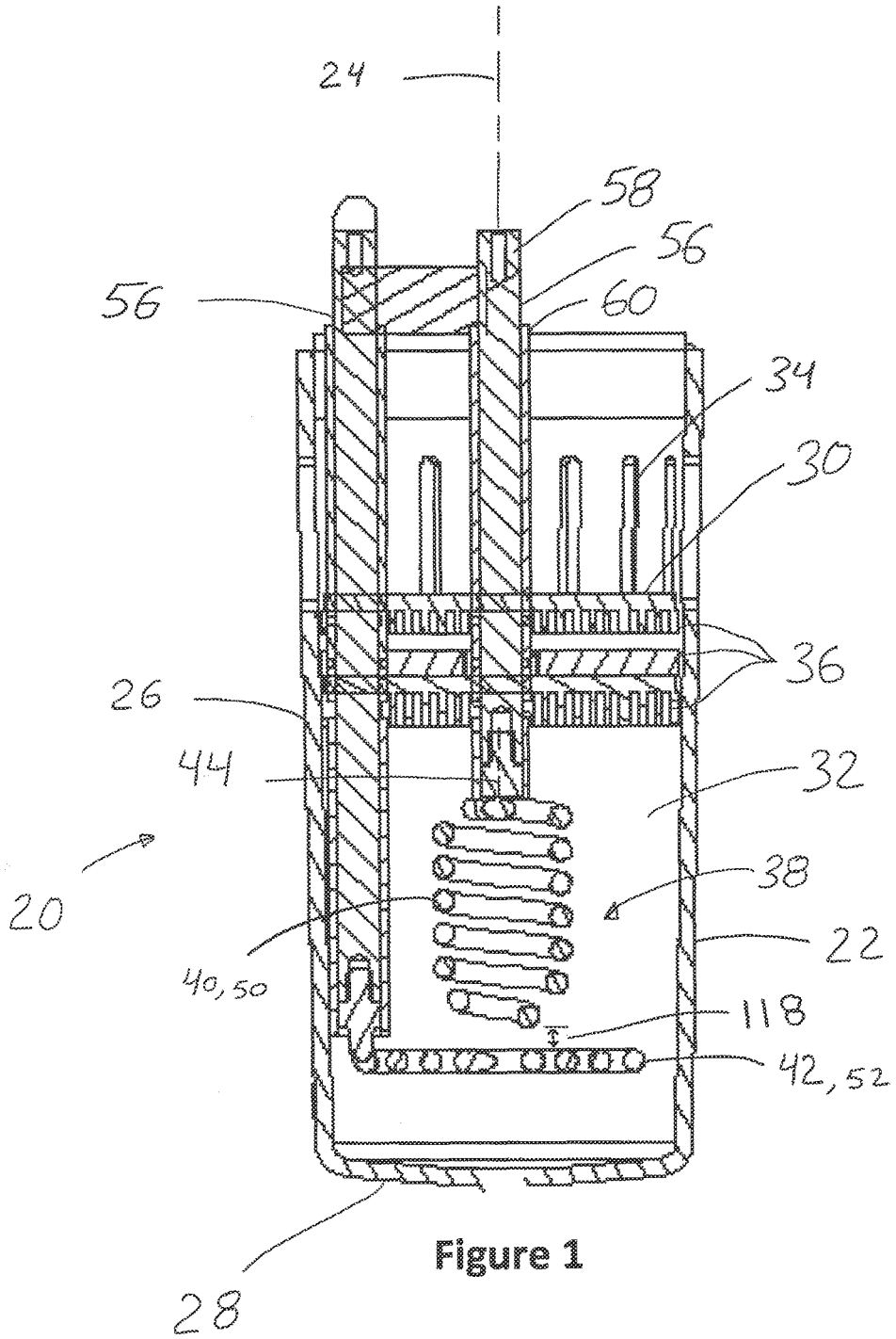
FIG. 1 is a cross-section view of a steam generator using a plasma arc according to an embodiment of the present invention.

In the following description, the same numerical references refer to similar elements. Furthermore, for the sake of simplicity and clarity, namely so as to not unduly burden the figures with several reference numbers, not all figures contain references to all the components and features, and references to some components and features may be found in only one figure, and components and features of the present invention illustrated in other figures can be easily inferred therefrom. The embodiments, geometrical configurations, materials mentioned and/or dimensions shown in the figures are optional, and are given for exemplification purposes only.

As shown in FIGS. 1 to 5, there is provided a steam generator 20 using a plasma arc submerged in electrolyte 32 for initiating a gradual plasma arc, heating the electrolyte 32 and generating steam therefrom. In a preferred embodiment, the electrolyte 32 comprises water and sodium hydrogen carbonate. It is understood that the steam generator 20 may also be used with other types of solvents and electrolytes such as potassium chloride, sodium hydroxide, sodium nitrate, etc.

The steam generator 20 includes a chamber 22 having a vertical axis 24 wherein a cathode 40 and an anode 42 (first electrode 50 and second electrode 52) are placed therein to form a plasma arc. The term "chamber" is intended to refer to the volume receiving the electrolyte 32 and its container wherein the plasma arc is generated to produce steam. The chamber 22 has an electrically non-conductive outer wall 26 to prevent, among other things, an electrical discharge. The chamber 22 also includes a base surface 28 and a top surface 30 located at opposite ends along the vertical axis 24. In the illustrated embodiment shown in FIG. 1, the chamber 22 further includes apertures 34 located on the top surface 30 for introducing the electrolyte 32 and/or removing the steam. In other embodiments, apertures 34 may also be located on the base surface 28 for introducing the electrolyte 32. The apertures 34 are closable for controlling the quantity of electrolyte 32 inside the chamber 22 and extracting the steam. The chamber 22 is preferably sized such that a ratio of the volume of the electrolyte 32 inside the chamber 22 to the volume of the cathode 40 inside the chamber is between 3 to 15 and preferably between 6 to 10. This ratio may vary depending on the electrolyte 32 used and the strength of a current energizing the cathode 40 and anode 42.

The chamber 22 further includes a deflector 36 for urging the electrolyte 32 towards an electrode assembly 38 mounted inside the chamber 22, comprising the cathode 40 and the anode 42, for ensuring continuous contact between the electrolyte 32 and the electrode assembly 38. The term "deflector" is intended to refer to devices and arrangements that are designed to maintain continuous contact between the electrolyte 32 and the electrode assembly 38 during the plasma reaction. The deflector 36 is preferably made from non-conductive and heat resistant material.

The electrode assembly 38 includes the first electrode 50, having a longitudinally extending spiral shape along a longitudinal axis 44, and the second electrode 52, having a flat spiral shape in a plane. The particular shape of the electrodes 50,52 considerably increases the life-span of the electrode assembly 38. For example, where a conventional straight electrode may have a one (1) second life-span, the electrodes 50,52 according to the illustrated embodiment may have a life-span ranging from forty (40) to a hundred (100) hours. Preferably, the first electrode 50 is the cathode 40 and the second electrode 52 is the anode 42 during the plasma reaction. The electrode assembly 38 is preferably made from high emissivity material.

Figure 2:
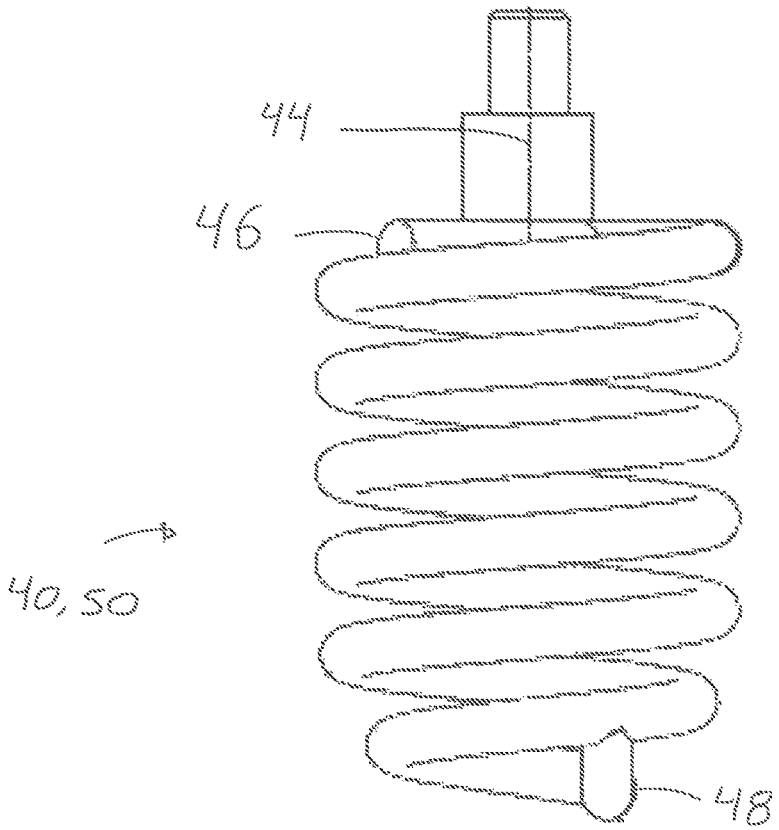
FIG. 2 is a perspective view of a first electrode according to an embodiment of the present invention.
Figure 3:
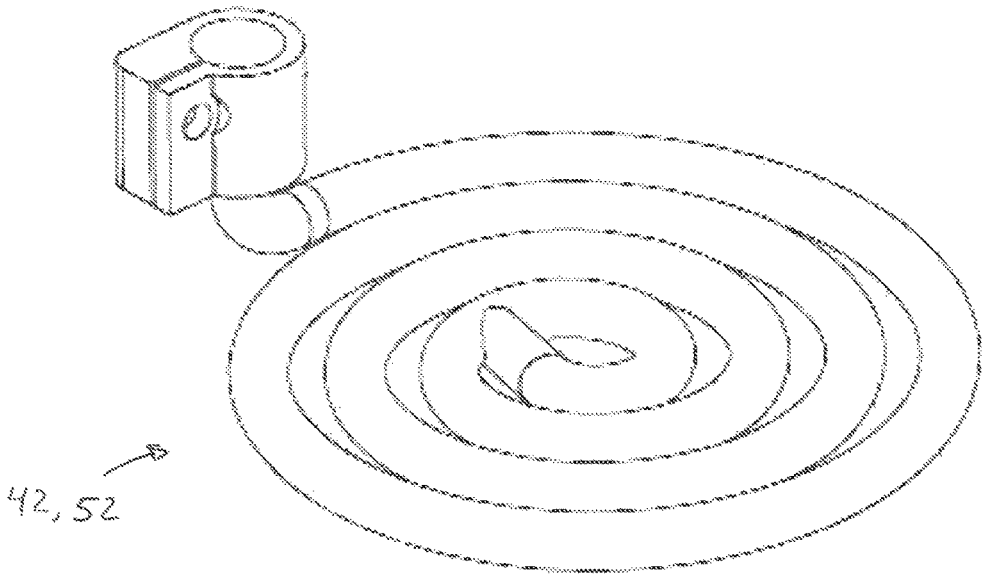
FIG. 3 is a perspective view of a second electrode a according to an embodiment of the present invention.

In the illustrated embodiment shown in FIG. 2, the first electrode 50 has a length starting with a circular cross-section 46 at the beginning of the length, i.e. at the end closer to a connection to a power source, and an oval cross-section 48 at the end of the length.

As shown in FIG. 1, the first electrode 50 is mounted inside the chamber 22 such that the longitudinal axis 44 is substantially parallel to the vertical axis 24 of the chamber. The second electrode 52 is mounted inside the chamber 22 at a distance 118 relative to the first electrode 50 such that the plane is substantially perpendicular to the longitudinal axis 44. The distance 118 between the oval cross-section 48 at the end of the length of the first electrode 50 and the centre of the second electrode 52 ranges from 10 mm to 150 mm, preferably, between 15.4 mm to 64.5 mm. The term "distance" is intended to refer to the shortest distance between the first electrode 50 and the second electrode 52.

The electrode assembly 38 is energized with an electrical alternating current provided by an electrical power source (not shown). The electrical power source produces an alternating input voltage 68 ranging from 200 V to 12 000 V, preferably between 200 V to 600 V AC. An input voltage 68 below 200 V may produce a week plasma arc and consequently affect the efficiency of the steam generator 20.

The electrode assembly 38 is connected to the power source using terminal connections 56. The terminal connections 56 comprise an electrically conductive inner core 58 and an electrically non-conductive outer jacket 60. Preferably, the inner core 58 is made of copper while the outer jacket 60 is made of ceramic.

Figure 4A:
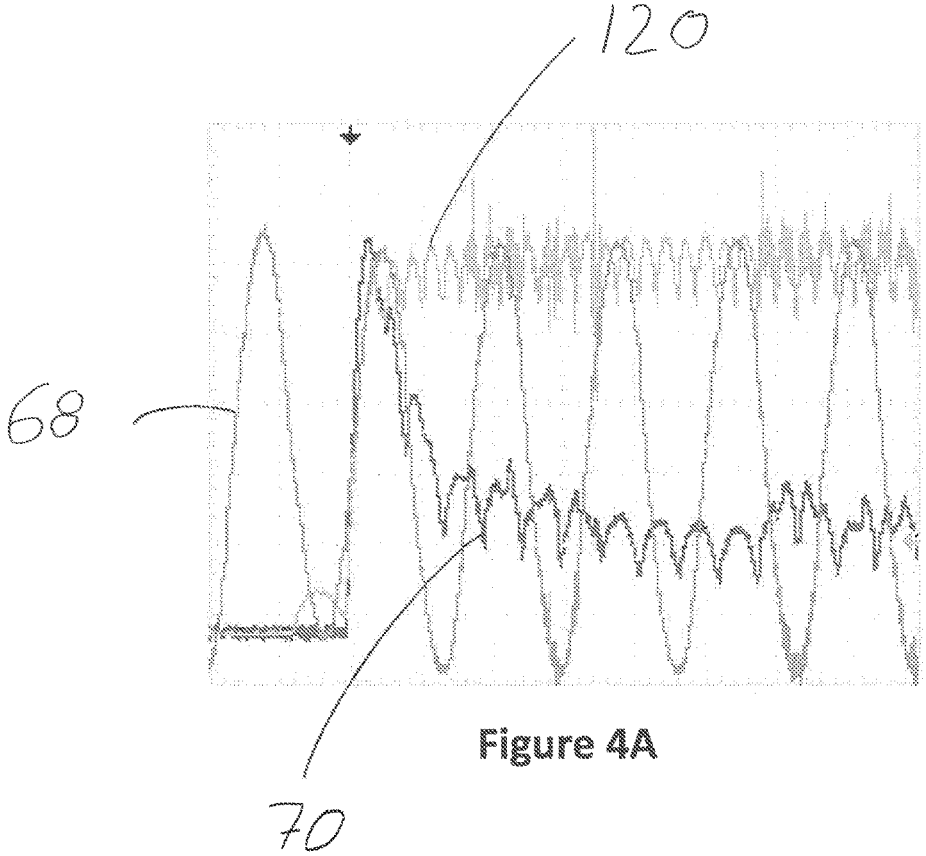
FIG. 4A is a diagram of an input voltage, a rectified voltage and a plasma current according to an embodiment of the present invention.
Figure 4B:
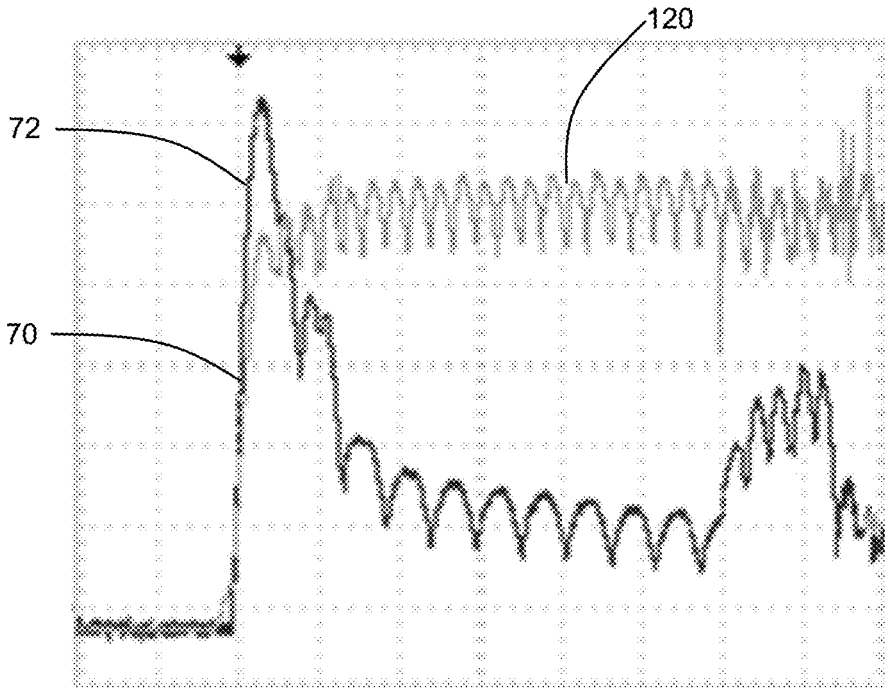
FIG. 4B is a diagram of an inrush current, a rectified voltage and a plasma current, initiating the plasma arc, according to an embodiment of the present invention.

The alternating current (AC) is converted into a direct current (DC) before supplying the electrode assembly 38. An electronic rectifier is used for converting the AC voltage into a DC voltage. The electronic rectifier is connected between the power source, for receiving the input voltage 68, and the terminal connections 56 for providing a rectified voltage. The electronic rectifier includes a controllable switch for rectifying the input voltage and a monitoring-controller for controlling the controllable switch. The term "controllable switch" is intended to refer to any one or more, or a combination of any suitable electrically controllable switch capable of converting alternating current to direct current, such as an electromechanical switch, a transistor, a thyristor, a silicon-controlled rectifier and an insulated-gate bipolar transistor. The monitoring-controller monitors the input voltage 68 and activates the controllable switch upon sensing a substantially zero input voltage 68, thereby synchronizing the activation of the controllable switch with the input voltage 68. One of the main advantages of activating the controllable switch when the input voltage 68 is substantially zero is initiating a gradual plasma arc current 70. As shown in FIGS. 4A and 4B, the gradual initiation limits the inrush current 72 initiating the plasma arc. Limiting the inrush current 72 may reduce wear and tear of the electrode assembly 38 and smooth the operation of the steam generator 20.

The steam generator 20 may also be used with two (2) or more electrode assembly 38 for reducing wear and tear of the first electrode 50 and the second electrode 52. Moreover, a constant flow of steam can be achieved by alternatively activating the electrode assemblies 38. In one embodiment, a method 74 for producing a constant flow output of steam including multiple electrode assemblies 38 in a steam generator 20 is used. The first step consists of monitoring 76 an input voltage 68, having alternating input waves, of an AC electrical power source in order to synchronize the input voltage 68 with the activation of the controllable switch. This can be done using the monitoring-controller. In a case of a polyphase system, the monitoring-controller can also detect the corresponding phase. The next step consists of rectifying 78 the input voltage 68 into a rectified voltage 120 for supplying the electrode assembly 38 with a direct current. A first electrode assembly 38 is supplied 80 with the rectified voltage 120 when the input voltage 68 is substantially zero and starting a positive half cycle input wave. After conducting the positive half cycle input wave, the rectified voltage 120 is cut 82 from the first electrode assembly 38, allowing 84 for a negative half cycle input wave to pass through the first electrode assembly 38. The final step consists of conducting 86 the rectified voltage 120 to a second electrode assembly when the input voltage 68 is substantially zero and starting a subsequent positive half cycle input wave. The steps are then repeated in an alternating fashion between the electrode assemblies used in the steam generator. For example, a steam generator with three electrode assemblies A, B and C, will alternate in the following fashion: A-B-C-A-B-C etc.

Figure 5:
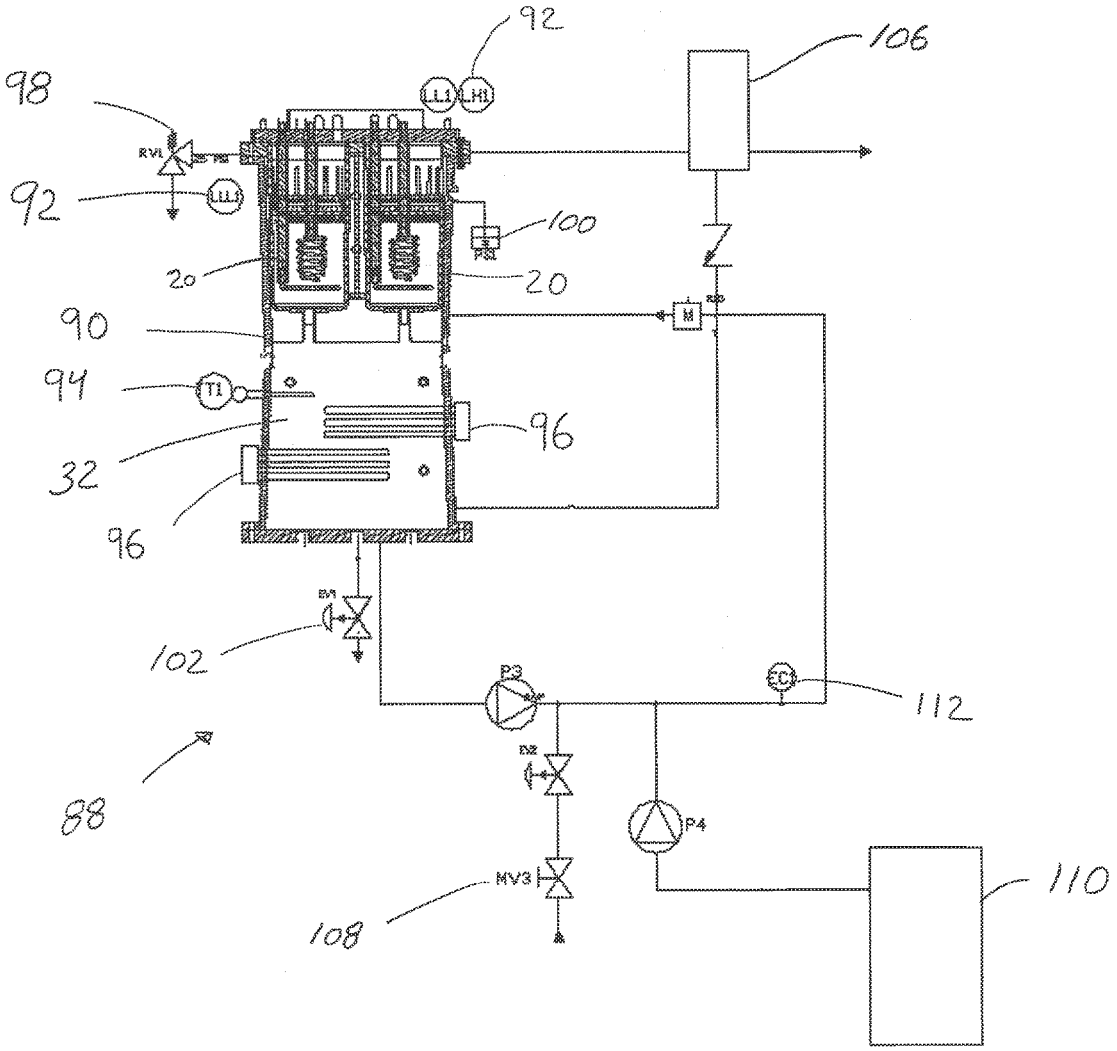
FIG. 5 is a schematic view of a steam generation assembly comprising two steam generators according to an embodiment of the present invention.
Figure 6:
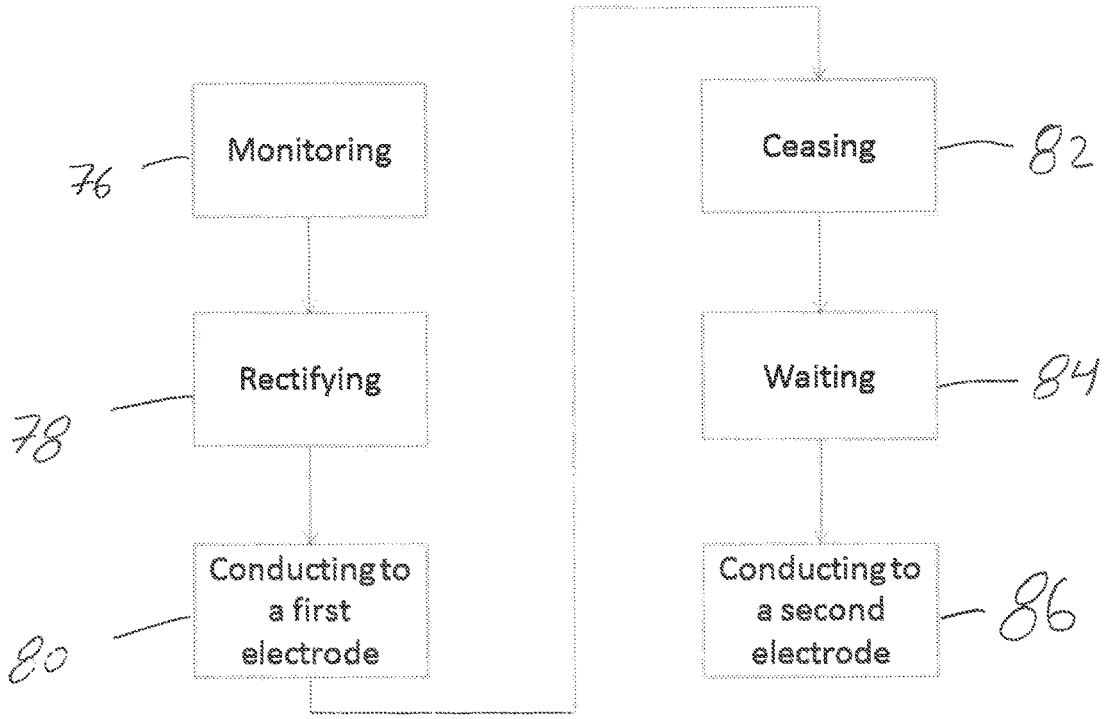
FIG. 6 a flow chart diagram of a method for producing a constant flow output of steam using multiple electrode assemblies in a steam generator according to an embodiment of the present invention.

In another embodiment, the steam generator 20 can also be integrated to a system 88 for generating a constant flow of steam. As shown in FIG. 5, the system comprises a reservoir 90 receiving a plurality of steam generators 20. The reservoir 90 may be made from conductive materials. Preferably, the reservoir 90 is made from a non-corrosive material such as stainless steel. The electrolyte 32 is placed in the reservoir 90 for feeding the steam generators 20. The system 88 also includes level probes 92 monitoring the electrolyte 32 quantity in the reservoir 90, the steam generators 20, etc. The system 88 preheats the electrolyte 32, preferably between 80 and 90 degrees Celsius, before feeding it to the steam generators 20. A temperature probe 94 and heating elements 96 are used to control the temperature of the electrolyte 32 before feeding the steam generators 20. The system 88 may also include a pressure valve 98 and a pressure probe 100 to limit the pressure inside the system 88. The reservoir 90 further includes a drainage valve 102 for emptying the electrolyte 32 allowing for maintenance and the like. The output of the steam generators 20 is connected to a vapor separator 106 allowing non-saturated steam to exist from the system 88 through a vapor output 104. Water is supplied to the system 88 through a water valve 108. The water valve 108 can be connected to a municipal water supply networks for providing the system 88 with water. An electrolyte tank 110 supplies the system 88, through a dosing pump 114, with a suitable electrolyte substance for mixing it with water and producing the electrolyte 32. A conductivity probe 112 is used to monitor the concentration of the electrolyte 32. The concentration is varied by controlling the quantity of water and/or electrolyte into the system 88. Finally, a flow switch 116 and a flow meter may also be included in the system 88 to monitor the proper functioning of electrolyte 32 circulation. The above described system 88 allows the continuous generation of steam.

Of course, numerous modifications could be made to the above-described embodiments without departing from the scope of the invention, as defined in the appended claims.

The invention claimed is:

1. A steam generator using a plasma arc submerged in electrolyte, the steam generator comprising:

a chamber having a vertical axis, said chamber includes an electrically non-conductive outer wall, a base surface and a top surface, said base surface and top surface are located at opposite ends of the chamber along the vertical axis, wherein the top surface includes at least one aperture for introducing the electrolyte and removing the steam;

an electrode assembly comprising:

a first electrode having a longitudinally extending spiral shape along a longitudinal axis mounted inside the chamber; and a second electrode having a flat spiral shape in a plane mounted inside the chamber relative to the first electrode for forming the plasma arc;

an electrical power source to energize the electrode assembly with an alternating-current input voltage;

terminal connections operatively connecting the first electrode and the second electrode to the power source; and an electronic rectifier operatively connected between the power source and the terminal connections, comprising:

a controllable switch for rectifying the alternating-current input voltage; and a monitoring-controller connected to the controllable switch for controlling said controllable switch;

wherein the monitoring-controller causes operation of the controllable switch upon sensing a substantially zero input voltage for initiating a gradual plasma arc, heating the electrolyte and generating steam therefrom.

2. The steam generator according to claim 1, wherein the base surface includes one aperture for introducing the electrolyte.

3. The steam generator according to claim 1, wherein the chamber further comprises a deflector for urging the electrolyte towards the electrode assembly.

4. The steam generator according to claim 3, wherein the deflector comprises an electrically non-conductive and heat resistant material.

5. The steam generator according to claim 1, wherein the chamber is sized such that the electrolyte defines a first volume while the first electrode defines a second volume, such that a ratio of the first volume to the second volume inside the chamber is between 3 to 15.

6. The steam generator according to claim 5, wherein the ratio of the first volume to the second volume is between 6 to 10.

7. The steam generator according to claim 1, wherein the at least one aperture is closable.

8. The steam generator according to claim 1, wherein the electrode assembly comprises a high emissivity material.

9. The steam generator according to claim 1, wherein the first electrode is a cathode.

10. The steam generator according to claim 1, wherein the first electrode has a length starting with a circular cross-section at the beginning of the length and ending with an oval cross-section at the end of the length.

11. The steam generator according to claim 1, wherein the second electrode is an anode.

12. The steam generator according to claim 1, wherein the longitudinal axis of the first electrode is substantially parallel to the vertical axis of the chamber.

13. The steam generator according to claim 1, wherein the plane of the second electrode is substantially perpendicular to the longitudinal axis of the first electrode.

14. The steam generator according to claim 1, wherein the first electrode is placed at a distance ranging between 10 mm to 150 mm from the second electrode.

15. The steam generator according to claim 1, wherein the first electrode is placed at a distance ranging between 15.4 mm to 64.5 mm from the second electrode.

16. The steam generator according to claim 1, wherein the input voltage of the electrical power source ranges between 200 V to 12 000 V AC.

17. The steam generator according to claim 1, wherein the input voltage of the electrical power source ranges between 200 V to 600 V AC.

18. The steam generator according to claim 1, wherein the terminal connections comprise an electrically conductive inner core and an electrically non-conductive outer jacket.

19. The steam generator according to claim 18, wherein the inner core comprises copper.

20. The steam generator according to claim 18, wherein the outer jacket comprises ceramic.

21. The steam generator according to claim 1, wherein the electronic rectifier produces a rectified DC voltage.

22. The steam generator according to claim 1, wherein the electronic rectifier comprises at least one current controlling device selected from a group consisting of thyristors, silicon-controlled rectifiers and insulated-gate bipolar transistors.

23. The steam generator according to claim 1, wherein the electrolyte comprises water and sodium hydrogen carbonate.

* * * * *